US011530811B2

(12) United States Patent
Mao et al.

(10) Patent No.: US 11,530,811 B2
(45) Date of Patent: Dec. 20, 2022

(54) LIGHT-EMITTING CHAIR LEG FRAME

(71) Applicant: DAKANG HOLDING CO., LTD., Zhejiang (CN)

(72) Inventors: Rujia Mao, Zhejiang (CN); Xiaoyu He, Zhejiang (CN); Guofei Yuan, Zhejiang (CN); Haitao Ouyang, Zhejiang (CN)

(73) Assignee: DAKANG HOLDING CO., LTD., Zhejiang (CN)

( * ) Notice: Subject to any disclaimer, the term of this patent is extended or adjusted under 35 U.S.C. 154(b) by 0 days.

(21) Appl. No.: 17/422,752

(22) PCT Filed: Jan. 2, 2020

(86) PCT No.: PCT/CN2020/070074
§ 371 (c)(1),
(2) Date: Jul. 14, 2021

(87) PCT Pub. No.: WO2021/103284
PCT Pub. Date: Jun. 3, 2021

(65) Prior Publication Data

US 2022/0128232 A1 Apr. 28, 2022

(30) Foreign Application Priority Data

Nov. 28, 2019 (CN) ..... 201922098349.4

(51) Int. Cl.
*F21V 33/00* (2006.01)
*A47C 7/72* (2006.01)
*F21Y 115/10* (2016.01)

(52) U.S. Cl.
CPC ..... *F21V 33/0012* (2013.01); *A47C 7/725* (2013.01); *F21Y 2115/10* (2016.08)

(58) Field of Classification Search
CPC .. F21V 33/0012; F21Y 2115/10; A47C 7/725; A47C 7/50; A47C 7/72; A47C 7/004; A47C 3/18
See application file for complete search history.

(56) References Cited

U.S. PATENT DOCUMENTS

2009/0154156 A1* 6/2009 Lo ..... F21S 4/28 362/234
2015/0048223 A1* 2/2015 Mika ..... A47C 7/004 248/188.7
2015/0300627 A1* 10/2015 Wang ..... F21V 33/0012 362/127
2017/0067628 A1* 3/2017 Branch ..... A47C 7/725
2019/0328142 A1* 10/2019 Ma ..... G02B 6/0078

FOREIGN PATENT DOCUMENTS

CN 108652308 10/2018
CN 208480907 2/2019
CN 208972995 6/2019
CN 110432680 11/2019

* cited by examiner

*Primary Examiner* — Erin Kryukova
(74) *Attorney, Agent, or Firm* — JCIP Global Inc.

(57) ABSTRACT

A light-emitting chair leg frame includes a base, a strip light, a light guide material layer, and a power supply assembly. At least one groove is disposed on the base. The strip light is disposed in the groove on the base. The light guide material layer covers the strip light. Light is refracted through the light guide material layer to form soft light. The power supply assembly is connected to the strip light. The strip light is covered through the light guide material layer, such that light is refracted in the light guide material layer.

6 Claims, 4 Drawing Sheets

LIGHT-EMITTING CHAIR LEG FRAME

CROSS-REFERENCE TO RELATED APPLICATION

This application is a 371 of international application of PCT application serial no. PCT/CN2020/070074, filed on Jan. 2, 2020 which claims the priority benefit of China application no. 201922098349.4 filed on Nov. 28, 2019. The entirety of each of the above mentioned patent applications is hereby incorporated by reference herein and made a part of this specification.

BACKGROUND

Technical Field

The disclosure relates to a chair leg frame, and more particularly to a light-emitting chair leg frame for creating an atmosphere.

Description of Related Art

With the vigorous development of the e-sports industry, various peripheral products related to e-sports emerge in endlessly. Professional e-sports players and most game players have special requirements for the atmosphere and visual effects of the entire game in order to pursue the game experience. As such, e-sports chairs came into being.

In addition to the pursuit of ultimate performance, the various e-sports related products launched on the market have a certain pursuit for cool effects of the appearance. The patent application with Application No. CN108652308A discloses a seat with side strip lights, including a seat body and a side strip light module. The side strip lights are disposed along an outer edge curve of a cushion part or an outer edge curve of a chair body part of the seat body. The visual effects of the e-sports seat are enhanced through light emission of the side strip light module, thereby satisfying the pursuit of the user for cool and dazzling effects. However, direct light emission through the side strip light causes the light to be not soft, the visual comfort is low after long-term contact, the visual effects are poor, and the overall e-sports chair does not have a high-end appearance. In addition, an e-sports chair that uses a light-emitting chair leg frame to create an atmosphere has not yet emerged in the prior art.

SUMMARY

In view of the above defects and issues of the prior art, the disclosure provides a light-emitting chair leg frame, which includes the following.

A base is provided with a shaft hole connected to a seat lifting rod assembly.

A strip light is disposed in the groove-shaped structure of the chair leg.

A light guide material layer covers the strip light. Light is refracted through the light guide material layer to form soft light.

A power supply assembly is connected to the strip light to supply electrical energy. The power supply assembly may be a power cord connected to a power source or an assembly that may independently provide electrical energy. Since the assembly is usually used in movable furniture, the power supply assembly is usually a lithium battery.

Preferably, the base is a disc-shaped or polygonal structure. The area of the disc-shaped or polygonal structure is sufficiently large to prevent the seat from rolling over.

Preferably, the light-emitting chair leg frame further includes chair legs, an inner end of each of the chair legs is disposed on the base, a number of the chair legs is not less than three, and a cross section of each of the chair legs is a groove-shaped structure that opens downward. The chair legs may be integrally formed with the base and may also be detachably connected to the base. The strip light is disposed at a bottom end of the groove-shaped structure. The light guide material layer covers the strip light.

Preferably, each of the chair legs is provided with an opening at the bottom end of the groove-shaped structure, the opening is covered by the light guide material layer. An upper end of the each of chair legs may emit soft light.

Preferably, each of the chair legs is provided with an opening on a side surface of the groove-shaped structure, the opening is covered by the light guide material layer. A side surface of each of the chair legs may emit soft light.

Preferably, each of the chair legs is provided with cross-linked reinforcing ribs at the bottom end of the groove-shaped structure to enhance the strength of the chair legs. The strip light is disposed on the reinforcing ribs.

Preferably, an outer end of each of the chair legs can be detachably connected to a universal wheel, so that the chair has mobility.

Preferably, the strip light may emit at least two colors of light, so that the overall light-emitting seat is more colorful to satisfy requirements of different users.

Preferably, the light guide material layer has various colors, which may be combined with the strip light, so that the overall light-emitting seat is more colorful to satisfy requirements of different users.

Preferably, the strip light is selected from one or more of an RGB light strip and an LED light strip.

Preferably, the light guide material layer is selected from one or more of foam, EVA, and EPE.

Preferably, the power supply assembly is a lithium battery.

Preferably, the light-emitting chair leg further includes a control module, which can control the strip light to emit light with at least one color and can receive a wireless control signal.

The beneficial effect of the disclosure is that the strip light is covered through the light guide material layer for light to be refracted in the light guide material layer, so that the light-emitting seat has soft lighting, high comfort, good visual effects, and high-end overall appearance. A manner of light emission at the bottom part of the seat is also provided to satisfy the pursuit of different users for cool effects.

DETAILED DESCRIPTION OF DISCLOSED EMBODIMENTS

Figure 1:
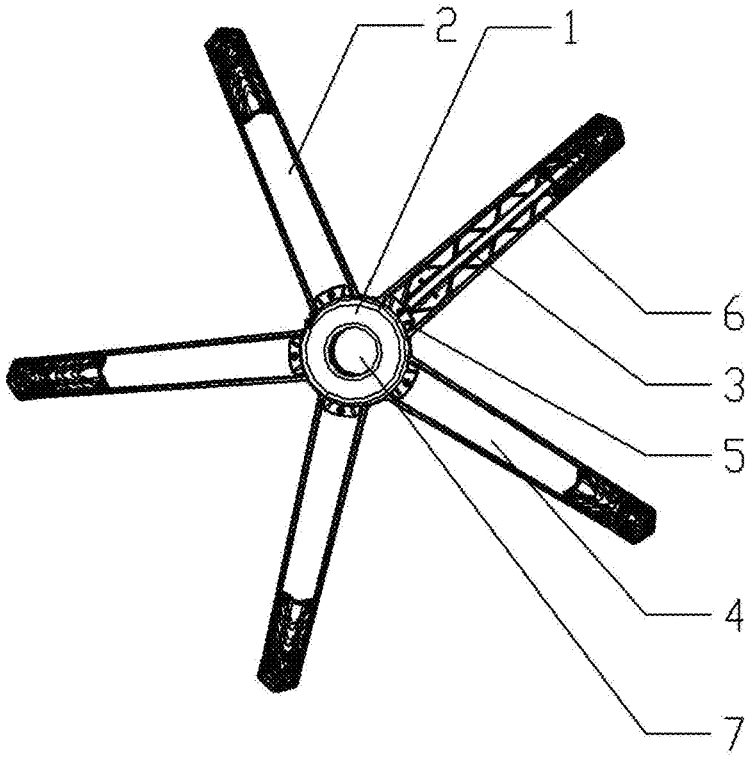
FIG. 1 is a bottom view of a light-emitting chair leg frame according to an embodiment of the disclosure.

The disclosure will be further described below in conjunction with the embodiments and the drawings.

As shown in FIGS. 1 to 3 and 5 to 6, a light-emitting chair leg frame includes a base 1, a plurality of chair legs 2, a strip light 3, a light guide material layer 4, and a power supply assembly 5. The base 1 is provided with a shaft hole 7 connected to a seat lifting rod assembly. The axial direction of the shaft hole 7 penetrates the base. An inner end of each chair leg 2 is disposed on the base 1, a number of the chair legs 2 is not less than three, and a cross section of each chair leg 2 is a groove-shaped structure 21 that opens downward. The chair legs 2 are integrally formed with the base 1. A back surface of the strip light 3 is fixed to a bottom end of a groove-shaped structure 21 of each chair leg 2 in a bonding manner. The light guide material layer 4 covers the strip light 3 and is fixed to a top end of the groove-shaped structure 21 of each chair leg 2 in a bonding manner. As shown in FIG. 4, light is refracted through the light guide material layer to form soft light, so that the overall seat is more aesthetically pleasing. When the distance between the strip light 3 and the light guide material layer 4 is greater than 15 mm, soft light effects are more obvious. The power supply assembly 5 is connected to the strip light 3 to supply electrical energy.

As shown in FIGS. 1 to 3 and 5 to 6, each of the chair legs 2 is provided with an opening 22 at the bottom end and on a side surface of the groove-shaped structure, and the opening 22 is covered by the light guide material layer 4. The openings may be disposed in any shape to satisfy requirements of different users. The openings of the product are disposed as long strip shape.

Figure 2:
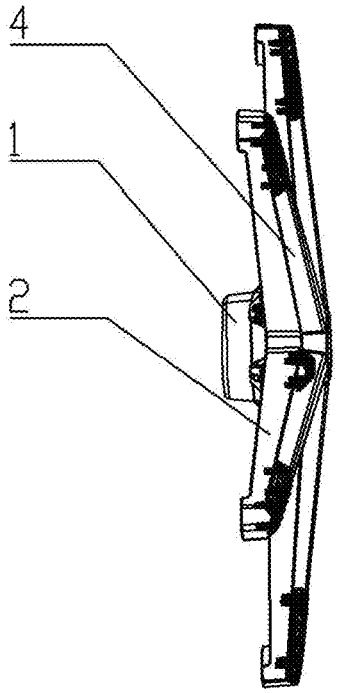
FIG. 2 is a side view of the light-emitting chair leg frame according to an embodiment of the disclosure.
Figure 3:
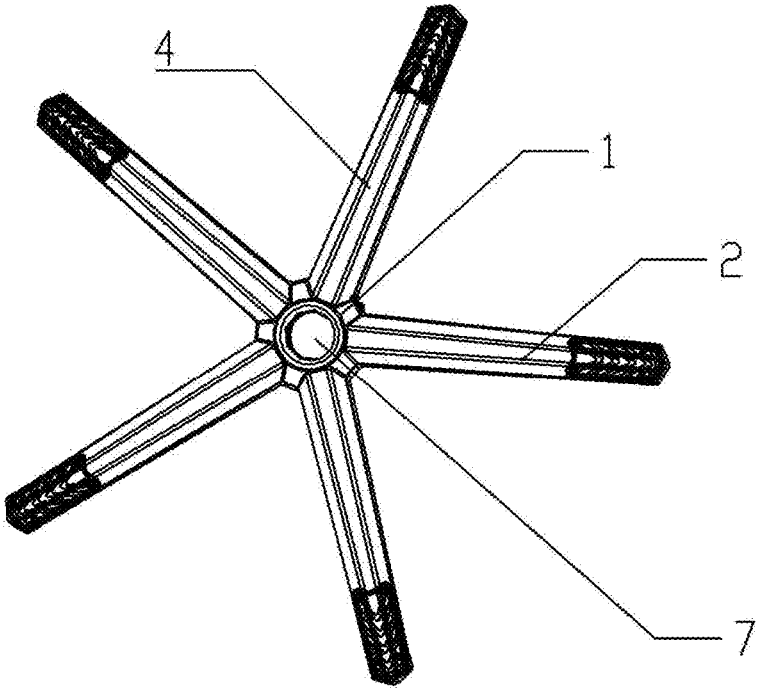
FIG. 3 is a top view of the light-emitting chair leg according to an embodiment of the disclosure.
Figure 4:
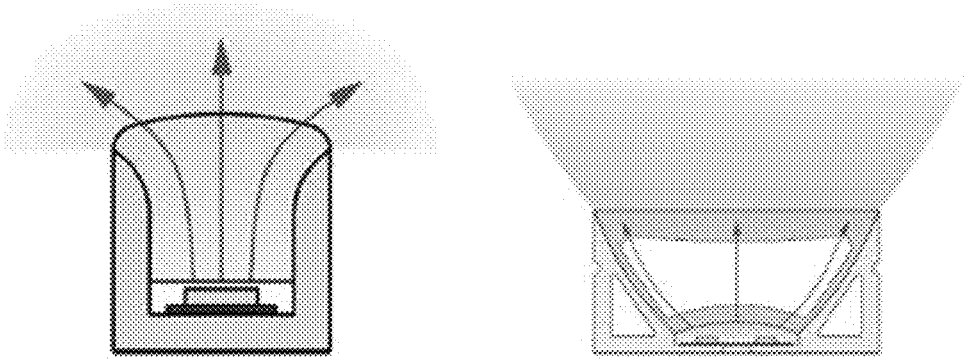
FIG. 4 is a comparison diagram of light rays from a strip light and light rays from a strip light covered with a light guide material layer.
Figure 5:
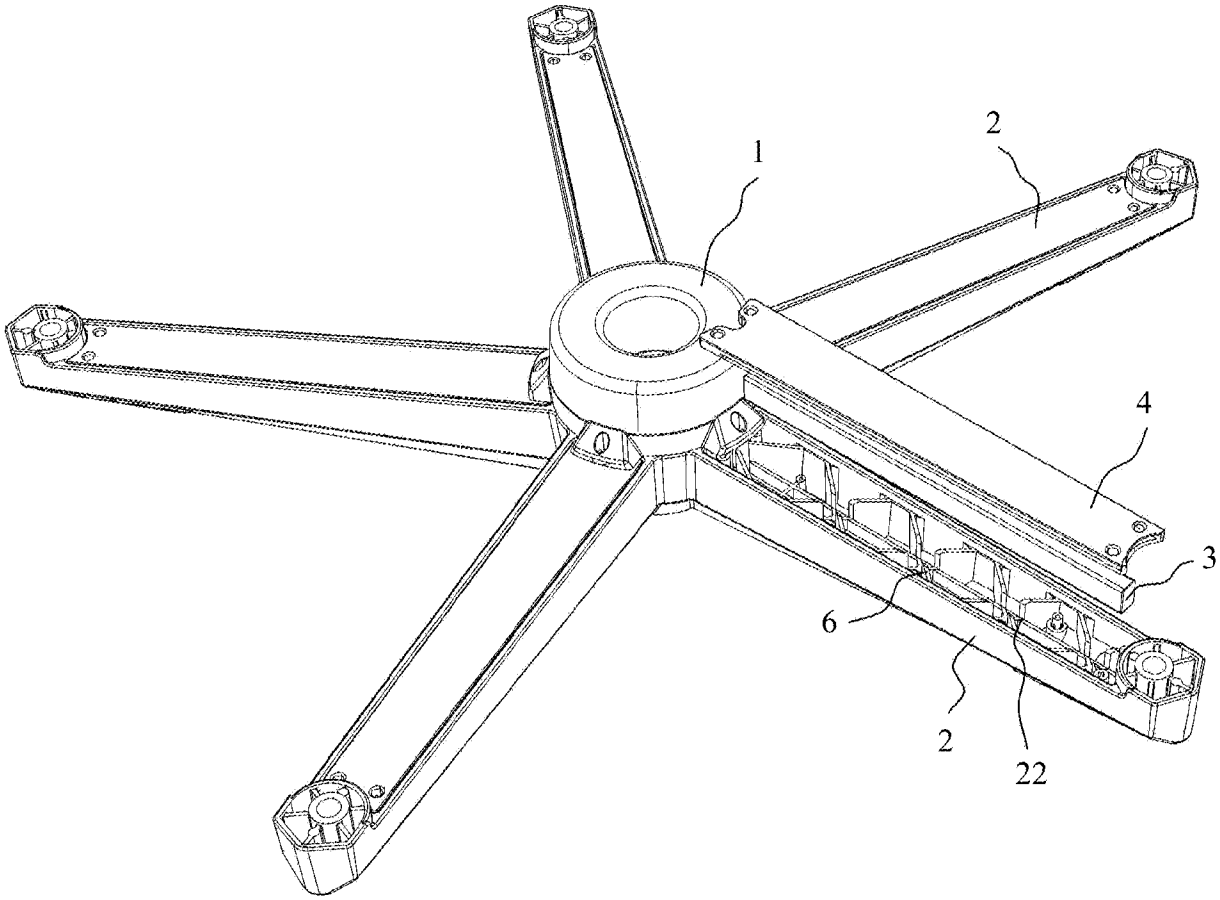
FIG. 5 is a bottom perspective view of the light-emitting chair leg frame according to an embodiment of the disclosure.
Figure 6:
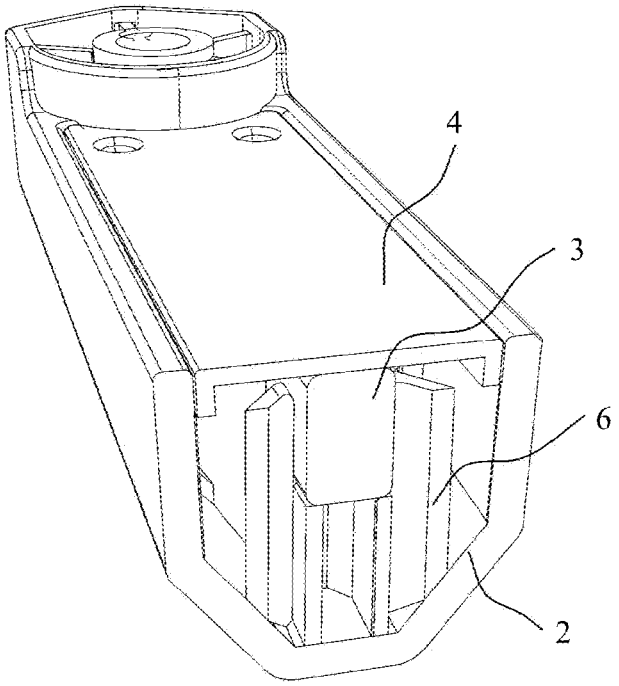
FIG. 6 is an enlarged perspective view showing structure of a chair leg of the light-emitting chair leg frame.

As shown in FIGS. 1 to 3, each of the chair legs 2 is provided with cross-linked reinforcing ribs 6 at the bottom end of the groove-shaped structure 21. The strip light is disposed on the reinforcing ribs.

As shown in FIGS. 1 to 3, an outer end of each of the chair legs 2 may be detachably connected with a universal wheel, so that the chair has mobility.

The strip light 3 may emit at least two colors of light, the light guide material layer 4 has various colors, and the two may emit combined color light. A control module may control a light-emitting color, a light sequence of each region, and whether to emit light, to satisfy requirements of different users. The control module may receive a wireless control signal, which includes a control signal of a wireless remote control handle and a control signal sent by a mobile phone.

The strip light 3 is an RGB light strip or an LED light strip. The light guide material layer is foam, EVA, or EPE.

Based on the mobility of the product, the lithium battery is used for power supply to reduce the trouble of wire winding. A power socket, a power switch, and a lighting mode button are disposed. Various colorful lighting modes are built in the system and are switched through the lighting mode button.

The above embodiments only express several implementation manners of the disclosure, and the description thereof is relatively specific and detailed. However, the embodiments should not be understood as limitations to the patent scope of the disclosure. It should be pointed out that for persons skilled in the art, several modifications and improvements may be made without departing from the concept of the disclosure, and the modifications and improvements all fall within the protection scope of the disclosure. Therefore, the protection scope of the disclosure should be defined by the appended claims.

What is claimed is:

1. A light-emitting chair leg frame, comprising:

a base;

a plurality of strip lights;

a plurality of light guide material layers, respectively covering the strip lights;

a power supply assembly, connected to the strip lights; and a plurality of chair legs, wherein an inner end of each of the chair legs is disposed on the base, a number of the chair legs is not less than three, a cross section of each of the chair legs is a groove-shaped structure that opens downward, each of the strip lights is disposed at a bottom end of the groove-shaped structure, and each of the light guide material layers covers a respective one of the strip lights, wherein each of the chair legs is provided with cross-linked reinforcing ribs at the bottom end of the groove-shaped structure, and each of the strip lights is disposed on the reinforcing ribs of a respective one of the chair legs.

2. The light-emitting chair leg frame according to claim 1, wherein the base is a disc-shaped structure.

3. The light-emitting chair leg frame according to claim 1, wherein each of the chair legs is provided with an opening at the bottom end of the groove-shaped structure, and the opening is covered by a respective one of the light guide material layers.

4. The light-emitting chair leg frame according to claim 1, wherein each strip light is selected from one or more of an RGB light strip and an LED light strip.

5. The light-emitting chair leg frame according to claim 1, wherein each light guide material layer is selected from one or more of foam, Ethylene Vinyl Acetate (EVA), and expanded polyethylene (EPE).

6. The light-emitting chair leg frame according to claim 1, wherein the power supply assembly is a lithium battery.

* * * * *